US010874187B2

(12) United States Patent
Sultana et al.

(10) Patent No.: US 10,874,187 B2
(45) Date of Patent: Dec. 29, 2020

(54) DEPILATORY DEVICES

(71) Applicant: Nahid Sultana, London (GB)

(72) Inventors: Nahid Sultana, London (GB); Sarah Al Sabah, London (GB)

( * ) Notice: Subject to any disclaimer, the term of this patent is extended or adjusted under 35 U.S.C. 154(b) by 0 days.

(21) Appl. No.: 16/754,057

(22) PCT Filed: Oct. 17, 2018

(86) PCT No.: PCT/GB2018/000137
§ 371 (c)(1),
(2) Date: Apr. 6, 2020

(87) PCT Pub. No.: WO2019/077293
PCT Pub. Date: Apr. 25, 2019

(65) Prior Publication Data

US 2020/0359766 A1 Nov. 19, 2020

(30) Foreign Application Priority Data

Oct. 17, 2017 (GB) ..... 1717049.9
Oct. 17, 2018 (GB) ..... 1816938.3

(51) Int. Cl.
*A45D 26/00* (2006.01)

(52) U.S. Cl.
CPC ..... *A45D 26/0047* (2013.01)

(58) Field of Classification Search
CPC ..... A61B 2017/00752; A45D 26/0047; A45D 26/0033; A45D 25/0004; A45D 26/00; A45D 2026/008
USPC ..... 606/133
See application file for complete search history.

(56) References Cited

U.S. PATENT DOCUMENTS 1,232,617 A * 7/1917 Shipp ..... A45D 26/0028 606/133
1,743,590 A * 1/1930 Binz ..... A45D 26/0047 606/133
2,486,616 A 11/1949 Schubiger
2002/0128664 A1 9/2002 Moghadam
2004/0249390 A1* 12/2004 Dovas ..... A45D 26/0047 606/133
2008/0190629 A1* 8/2008 Zeyger ..... A01B 1/16 172/378

FOREIGN PATENT DOCUMENTS

GB 1816938.3 4/2019

* cited by examiner

*Primary Examiner* — George J Ulsh

(57) ABSTRACT

Disclosed is depilatory device comprising a coil spring having retainable ends; a longitudinal first member configured to receive one retainable end of the coil spring, wherein the retainable end of the coil spring is retained in the longitudinal first member; and a longitudinal second member configured to receive another retainable end of the coil spring, wherein the other retainable end of the coil spring is retained in the longitudinal second member. The longitudinal first member is configured to couple with the longitudinal second member to conceal the coil spring, when the depilatory device is maintained in an unused state; and the longitudinal first member is separated from the longitudinal second member to reveal the coil spring for performing a depilatory action, when the depilatory device is in use.

20 Claims, 1 Drawing Sheet

DEPILATORY DEVICES

TECHNICAL FIELD

The present disclosure relates generally to cosmetic products; and more specifically, to depilatory devices.

BACKGROUND

Unwanted hair on the face or body is usually removed by chemicals, waxing, electrolysis, threading or laser hair removal treatment. These methods of hair removal can be messy and/or expensive and often require multiple visits to the beautician. There has always been a need in the market, therefore, for hair removing devices that can be used by the removing hair with laser or waxing can harm the skin, whereas the threading method with alternative fine string is a natural process to pull hair out from the root but quite tricky as the string can break and also catch the skin between the string which is quite painful.

One such example of a self-use hair removing device is a hand held depilatory coil device. There is a exposed coil in the centre between handles on each distal end currently on the market. However, the user will find the coil has to be covered with a cover, which can be easily misplaced and not easy on the go use. Without protecting the coil with a cover, the coil can easily get damaged or bacteria transferred which can cause possible spots or irritation, therefore further pain.

These devices are used by mainly by females, women and growing teenagers. Teenagers and most women may find this device medieval cold looking tool and difficult to look after to keep clean which can consume time, causing the coil to rust over time. Furthermore, these devices cannot generally be used to perform eyebrow shaping or have other beauty tools arranged within the device, for example a tweezer conveniently stored within the device. Therefore, in light of the foregoing discussion, these exists a need to overcome the aforementioned drawbacks associated with conventional depilatory devices having bulky designs and/or unfashionable form-factors.

SUMMARY

The present disclosure seeks to provide an improved depilatory device.

According to a first aspect, an embodiment of the present disclosure provides a depilatory device comprising:

- a coil spring having retainable ends;
- a longitudinal first member configured to receive one retainable end of the coil spring, wherein the retainable end of the coil spring is retained in the longitudinal first member; and
- a longitudinal second member configured to receive another retainable end of the coil spring, wherein the other retainable end of the coil spring is retained in the longitudinal second member;

wherein

- the longitudinal first member is configured to couple with the longitudinal second member to conceal the coil spring, when the depilatory device is maintained in an unused state; and
- the longitudinal first member is separated from the longitudinal second member to reveal the coil spring for performing a depilatory action, when the depilatory device is in use.

The present disclosure seeks to provide the depilatory device comprising the longitudinal first and second members respectively that can be separated to reveal the coil spring, such that the coil spring can be employed for performing the depilatory action. The depilatory device can be manufactured to have a small form-factor and a stylish deign, thereby, enabling users to conveniently carry and use the depilatory device.

It will be appreciated that features of the present disclosure are susceptible to being combined in various combinations without departing from the scope of the present disclosure as defined by the appended claims.

DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams wherein.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DESCRIPTION OF EMBODIMENTS

In overview, embodiments of the present disclosure are concerned with depilatory devices.

Figure 1:
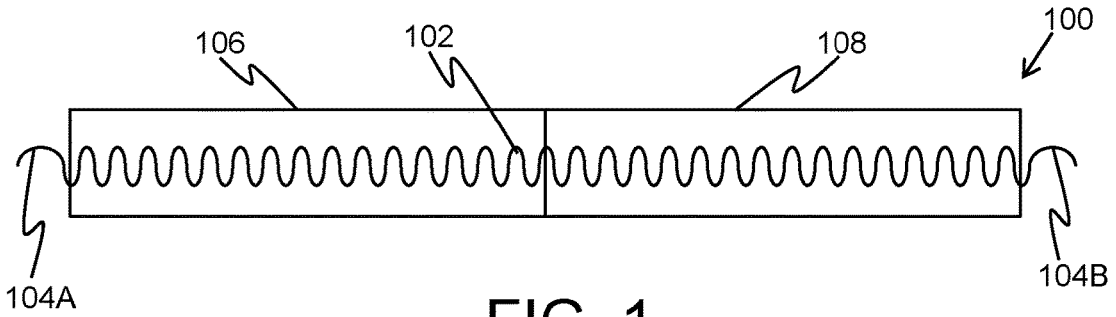
FIG. 1 is a schematic illustration of a depilatory device, in accordance with an embodiment of the present disclosure.

Referring to FIG. 1, there is shown a schematic illustration of a depilatory device 100, in accordance with an embodiment of the present disclosure. The depilatory device 100 comprises a coil spring 102 having retainable ends 104A-B. The coil spring 102 enables a user of the depilatory device 100 to perform a depilatory action. In an embodiment, the coil spring 102 is implemented as a round helical spring. For example, the user can move the coil spring 102 along an area of a body (such as, along a face of the user) thereof, wherein skin on such an area of the body of the user has unwanted hair thereon. In such an example, the unwanted hair on the skin of the user gets caught between coils of the coil spring 102. Subsequently, as the user applies force on the depilatory device 100 to move the depilatory device 100 to another area of the body thereof, the hair caught between the coils of the coil spring 102 is plucked from the skin of the user. For best results the user may hold the device 100 using both hands by holding each side. It will be appreciated that as the user moves the depilatory device 100 from one area of the body thereof to another area at a fast pace, the hair on the skin is removed. Furthermore, the user can use the depilatory device 100 by keeping the coil spring 102 in a bent state and/or by rolling the coil spring 102 over the area of the body thereof. Optionally, the coil spring 102 can be implemented to have only one retainable end 104A (or 104B) and another end of the coil spring 102 is implemented as a regular end 104B (or 104A). More optionally, the coil spring 102 can be implemented to have a non-circular cross-section.

The depilatory device 100 comprises a longitudinal first member 106 configured to receive one retainable end 104A of the coil spring 102, wherein the retainable end 104A of the coil spring 102 is retained in the longitudinal first member 106, and a longitudinal second member 108 configured to receive another retainable end 104B of the coil spring 102, wherein the other retainable end 104B of the coil spring 102 is retained in the longitudinal second member 108. For example, the longitudinal first member 106 and the longitudinal second member 108 can be implemented as substantially cylindrical hollow elements. In such an example, the longitudinal first member 106 and the longitudinal second member 108 can have a same internal and external diameters or similar (such as, to within 90%) internal and external diameters. Alternatively, the longitudinal first member 106 and the longitudinal second member 108 can be implemented to have different cross-sections with respect to each other. For example, the longitudinal first member 106 is implemented to have a rectangular cross-section and the longitudinal second member 108 is implemented to have a triangular cross-section.

In one embodiment, the longitudinal first member 106 and the longitudinal second member 108 can be implemented to have same lengths. Alternatively, the longitudinal first member 106 and the longitudinal second member 108 can be implemented to have different lengths with respect to each other. For example, the longitudinal first member 106 can be implemented to have the length in a range of 30% to 70% of a total length of the depilatory device 100 and the longitudinal second member 108 can be implemented to have the length in a range of 70% to 30% of the total length of the depilatory device 100. The longitudinal first member 106 and the longitudinal second member 108 can be held by each hand to control pulling and rotating actions when removing hair from the exposed spring 102.

Furthermore, during fabrication of the depilatory device 100, one retainable end 104A of the coil spring 102 is received into the longitudinal first member 106 and the other retainable end 104B of the coil spring 102 is received into the longitudinal second member 108. It will be appreciated that an internal diameter of each of the longitudinal first member 106 and the longitudinal second member 108, is more than a diameter of the coil spring 102, such as, to enable the coil spring 102 to be received into the longitudinal first member 106 and the longitudinal second member 108 respectively.

In an embodiment, the retainable ends 104A-B of the coil spring 102 are implemented as one of: open-ended hooks, closed-ended hooks, coils having a smaller diameter as compared to a diameter of the coil spring 102, coils having a bigger diameter as compared to the diameter of the coil spring 102, at least one coil having an increased separation therebetween as compared to other coils of the coil spring 102, at least two concentric coils arranged along a same plane, a helical shaped coil on a same plane. For example, the coil spring 102 has the diameter that substantially corresponds to the internal diameter (of a hollow portion) of each of the longitudinal first member 106 and the longitudinal second member 108 respectively. Furthermore, the retainable ends 104A-B of the coil spring 102 are implemented to have the bigger diameter as compared to the diameter of the coil spring 102. Such retainable ends 104A-B of the coil spring 102 are received into the longitudinal first member 106 and the longitudinal second member 108 by compressing and subsequently, pushing the retainable ends 104A-B into the longitudinal first member 106 and the longitudinal second member 108 respectively. Thereafter, once the retainable ends 104A-B are received into the longitudinal first member 106 and the longitudinal second member 108 respectively, the retainable ends 104A-B are configured to expand and acquire a form of the retainable ends 104A-B having the bigger diameter as compared to the diameter of the coil spring 102. In such an example, the diameter of the retainable ends 104A-B can be bigger than the external diameter of each of the longitudinal first member 106 and the longitudinal second member 108 respectively. Consequently, once the coil spring 102 is received into the longitudinal first member 106 and the longitudinal second member 108, the bigger diameter of the retainable ends 104A-B enable to prevent escape of the coil spring 102 from each of the longitudinal first member 106 and the longitudinal second member 108 respectively. In another example, the retainable ends 104A-B of the coil spring 102 are implemented as at least two concentric coils arranged along a same plane. In such an example, the at least two concentric coils act as a substantially flat circular disc arranged at the ends of the coil spring 102, wherein such a substantially flat circular disc is associated with a bigger diameter than the external diameter of each of the longitudinal first member 106 and the longitudinal second member 108 respectively. Consequently, the bigger diameter of the substantially flat circular disc enable to prevent escape of the coil spring 102 from each of the longitudinal first member 106 and the longitudinal second member 108 respectively.

In an embodiment, the longitudinal first member 106 and/or the longitudinal second member 108 comprises a stopper for retaining the retainable ends 104A-B of the coil spring 102. For example, the stopper can be implemented as a collar that is arranged near an end of each of the longitudinal first member 106 and the longitudinal second member 108 respectively, wherein such an end is adjacent to the retainable ends 104A-B of the coil spring 102 (when the coil spring 102 has been received into the longitudinal first member 106 and the longitudinal second member 108 respectively). Furthermore, when the retainable ends 104A-B of the coil spring 102 are implemented as coils having the bigger diameter as compared to the diameter of the coil spring 102 (and smaller diameter as compared to the external diameter of the longitudinal first member 106 and the longitudinal second member 108), the retainable ends 104A-B can still move into longitudinal first member 106 and the longitudinal second member 108 respectively. However, the collar implemented near the end of the longitudinal first member 106 and the longitudinal second member 108 will prevent movement of the retainable ends 104A-B beyond the collar, thereby preventing escape of the coil spring 102 from the longitudinal first member 106 and the longitudinal second member 108 respectively. On another embodiment the collar near both ends will prevent the spring 102 beyond the collar escape and on the other end will prevent the retainable ends escape from the longitudinal first member 106 and the longitudinal second member 108 respectively.

In one embodiment, the depilatory device 100 further comprises a lid (not shown) fixedly, detachably or hingedly coupled to an open end of each of the longitudinal first member 106 and the longitudinal second member 108. For example, when the retainable ends 104A-B of the coil spring 102 are implemented as coils having the bigger diameter as compared to the diameter of the coil spring 102 (and smaller diameter as compared to the external diameter of the longitudinal first member 106 and the longitudinal second member 108), and the retainable ends 104A-B can move into the longitudinal first member 106 and the longitudinal second member 108, the lids close the longitudinal first member 106 and the longitudinal second member 108, thereby, preventing escape of the retainable ends 104A-B out of corresponding ends of the longitudinal first member 106 and the longitudinal second member 108 respectively. Furthermore, the lids can be implemented to permanently close the longitudinal first member 106 and the longitudinal second member 108 (such as, by integrally fabricating the lids with the longitudinal first member 106 and the longitudinal second member 108) or the lids can be configured to be opened and closed as required (such as, by fabricating the lids to be detachably or hingedly coupled to the open end of each of the longitudinal first member 106 and the longitudinal second member 108).

The longitudinal first member 106 is configured to couple with the longitudinal second member 108 to conceal the coil spring 102, when the depilatory device 100 is maintained in an unused state. It will be appreciated that when the depilatory device 100 is not required to be used by the user, maintaining the coil spring 102 in an unsheltered state may damage the coil spring 102, for example, due to threads of a clothing material of the user getting entangled in between the coils of the coil spring 102. Therefore, to prevent such damage to the coil spring 102, when the depilatory device 100 is not required to be used by the user, the longitudinal first member 106 is coupled with the longitudinal second member 108, thereby concealing the coil spring 102 therein.

In an embodiment, the longitudinal first member 106 is implemented as a male member and the longitudinal second member 108 is implemented as a female member. Alternatively or additionally, each of the longitudinal first member 106 and the longitudinal second member 108 comprise magnetic ends. Alternatively or additionally, the longitudinal first member 106 comprises threads on an external surface thereof and the longitudinal second member 108 comprises threads on an internal surface thereof. Alternatively or additionally, an end of the longitudinal first member 106 is configured to snap-fit into an end of the longitudinal second member 108. In an example, an end of the longitudinal first member 106 that is not proximate to the retainable end 104A of the coil spring 102 (when the coil spring 102 is received into the longitudinal first member 106) comprises the male member, wherein the male member is implemented as a cylindrical member having a smaller diameter than a remainder of the longitudinal first member 106. Furthermore, an end of the longitudinal second member 108 that is not proximate to the retainable end 104B of the coil spring 102 (when the coil spring 102 is received into the longitudinal second member 108) comprises the female member, wherein the female member is implemented as a cylindrical member having a bigger diameter as compared to the diameter of the male member of the longitudinal first member 106. In such an example, the male member is configured to be received into the female member, thereby enabling fixed coupling of the longitudinal first member 106 with the longitudinal second member 108. In another example, ends of each of the longitudinal first member 106 and the longitudinal second member 108 that are not proximate to the retainable ends 104A-B of the coil spring 102 respectively (when the coil spring 102 is received into the longitudinal first member 106 and the longitudinal second member 108 respectively) are configured to be magnetic, such as, the end of the longitudinal first member 106 is configured to have a magnetic north pole and the end of the longitudinal second member 108 is configured to have a magnetic south pole. In such an example, when the longitudinal first member 106 is brought in proximity to the longitudinal second member 108, opposite polarities of ends thereof enable attraction therebetween. Consequently, the longitudinal first member 106 and the longitudinal second member 108 can be fixedly coupled to each other.

In one embodiment, each of the longitudinal first member 106 and the longitudinal second member 108 are provided with centre fittings (not shown), wherein the centre fittings enable the longitudinal first member 106 to couple with the longitudinal second member 108. Such centre fittings can be fixedly or detachably coupled to each of the longitudinal first member 106 and the longitudinal second member 108, such as, by joining the centre fittings to the ends of the longitudinal first member 106 and the longitudinal second member 108 and subsequently, rotating the centre fittings (such as in a clockwise direction). It will be appreciated that the longitudinal first member 106, the longitudinal second member 108 and the centre fittings will comprise appropriate means for enabling such coupling therebetween (such as, external screw threads provided along ends of each of the longitudinal first member 106 and the longitudinal second member 108, and internal screw threads provided along the centre fittings). Subsequently, the centre fittings are operable to be coupled together, for enabling coupling between the longitudinal first member 106 and the longitudinal second member 108. For example, the centre fittings can be fabricated to be magnetic, such that when the centre fittings are brought in proximity to each other, opposite polarities thereof enable attraction therebetween and consequently, the longitudinal first member 106 and the longitudinal second member 108 can be fixedly coupled to each other. The centre fittings may also comprise as a push fit, collet fit an interference fit, click fit or snapfit.

Figure 2:
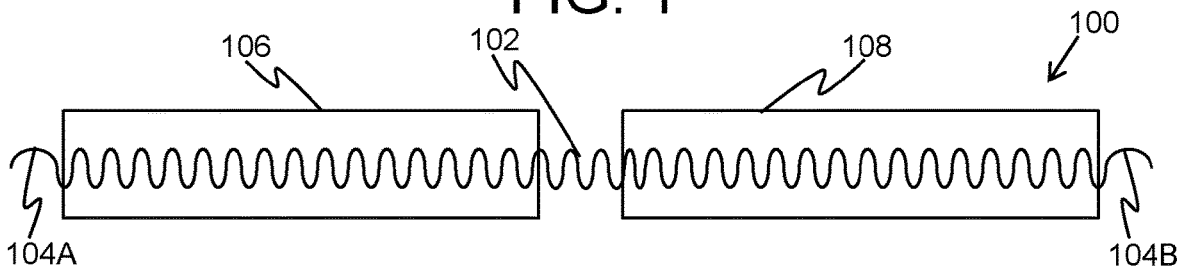
FIG. 2 is a schematic illustration of the depilatory device of FIG. 1, in accordance with another embodiment of the present disclosure.

Referring to FIG. 2, there is shown a schematic illustration of the depilatory device 100 of FIG. 1, in accordance with another embodiment of the present disclosure. As shown, the longitudinal first member 106 is separated from the longitudinal second member 108 to reveal the coil spring 102 for performing a depilatory action, when the depilatory device 100 is in use. It will be appreciated that during use of the depilatory device 100, the coil spring 102 is required to be exposed (or revealed) to enable contact of coils of the coil spring 102 with the skin of the user. Consequently, the longitudinal first member 106 is separated from the longitudinal second member 108 (such as, by separating the detachable coupling therebetween) to reveal the coil spring 102, thus enabling use of the coil spring 102 for performing the depilatory action (as explained hereinbefore). For example, when the longitudinal first member 106 is implemented to comprise threads on an external surface thereof (such as, at the end of the longitudinal first member 106 that is not proximate to the retainable end 104A of the coil spring 102) and the longitudinal second member 108 is implemented to comprise threads on an internal surface thereof (such as, at the end of the longitudinal second member 108 that is not proximate to the retainable end 104B of the coil spring 102), the end of the longitudinal first member 106 is joined to the end of the longitudinal second member 108 and subsequently rotated (such as in a clockwise direction) to enabling detachable coupling therebetween (when the depilatory device 100 is not in use). In such an example, the longitudinal first member 106 is rotated in an opposite direction (such as in an anti-clockwise direction) to decouple the longitudinal second member 108 therefrom and subsequently, pulled apart to reveal the coil spring 102 for performing the depilatory action.

Figure 3:
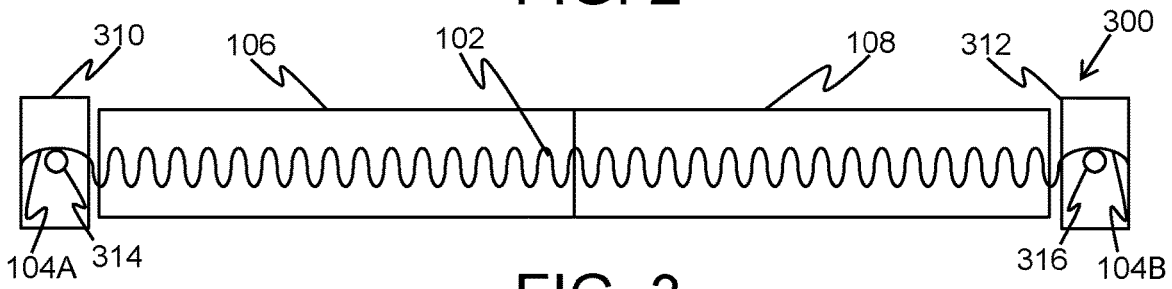
FIG. 3 is a schematic illustration of a depilatory device (such as the depilatory device of FIGS. 1 and 2), in accordance with an embodiment of the present disclosure.

Referring to FIG. 3, there is shown a schematic illustration of a depilatory device 300 (such as the depilatory device 100 of FIGS. 1 and 2), in accordance with an embodiment of the present disclosure. As shown, the depilatory device 300 comprises retainers 310 and 312 respectively that are detachably coupled to each retainable end 104A-B of the coil spring 102, after the corresponding retainable end 104A-B of the coil spring 102 is received in the longitudinal first member 106 or the longitudinal second member 108, wherein the retainers 310 and 312 respectively are configured to prevent release of the corresponding retainable end 104A-B of the coil spring 102 from the longitudinal first member 106 or the longitudinal second member 108 respectively. For example, after the retainable ends 104A-B of the coil spring 102 are received into the longitudinal first member 106 and the longitudinal second member 108, the retainable ends 104A-B are coupled to the retainers 310 and 312 respectively. Such retainers 310 and 312 enable to prevent release of the retainable ends 104A-B from the ends of the longitudinal first member 106 and the longitudinal second member 108, by obstructing movement of the retainable ends 104A-B beyond the ends of the longitudinal first member 106 and the longitudinal second member 108 respectively.

According to an embodiment, the retainers 310 and 312 are implemented to have a circular cross-section, and wherein a diameter of the retainers 310 and 312 respectively is bigger than the diameter of the coil spring 102. For example, the retainers 310 and 312 can be implemented as cylindrical elements having the diameter bigger than the diameter of the coil spring 102 as well as the diameter of the external surfaces of the longitudinal first member 106 and the longitudinal second member 108 respectively. In another example, the retainers 310 and 312 can be implemented to have a rectangular cross-section, a triangular cross-section and so forth. In such examples, after the retainers 310 and 312 are coupled to the retainable ends 104A-B of the coil spring 102, the retainers 310 and 312 having the bigger diameter than the external surfaces of the longitudinal first member 106 and the longitudinal second member 108, prevent escape of the retainable ends 104A-B into the longitudinal first member 106 and the longitudinal second member 108 respectively. Alternatively, or additionally, the retainers 310 and 312 comprise a collar (not shown) for preventing release thereof from the longitudinal first member 106 and the longitudinal second member 108. Such a collar can be arranged near an upper end (or a lower end) of the retainers 310 and 312. Furthermore, when the retainers 310 and 312 are implemented to have the circular cross-section such that the diameter of the retainers 310 and 312 respectively is smaller than or equal to the diameter of the coil spring 102 (and/or the internal diameter of the longitudinal first member 106 and the longitudinal second member 108 respectively), the collar of the retainers 310 and 312 has a bigger diameter than the diameter of the coil spring 102 (and/or the internal diameter of the longitudinal first member 106 and the longitudinal second member 108 respectively). Consequently, the collar of the retainers 310 and 312 is obstructed against the corresponding end of the longitudinal first member 106 and the longitudinal second member 108, thereby, preventing escape of the retainers 310 and 312 into the longitudinal first member 106 and the longitudinal second member 108 respectively.

According to an embodiment, each of the longitudinal first member 106 and the longitudinal second member 108 are provided with end fittings (not shown), wherein the end fittings are configured to prevent escape of the retainers 310 and 312 from the longitudinal first member 106 and the longitudinal second member 108 respectively. Such end fittings can be fixedly or detachably coupled to each of the longitudinal first member 106 and the longitudinal second member 108, such as, by joining the end fittings to the ends of the longitudinal first member 106 and the longitudinal second member 108 (that are proximate to the retainable ends 104A-B of the coil spring 102) and subsequently, rotating the end fittings (such as in a clockwise direction). It will be appreciated that the longitudinal first member 106, the longitudinal second member 108 and the end fittings will comprise appropriate means for enabling such coupling therebetween (such as, external screw threads, provided along ends of each of the longitudinal first member 106 and the longitudinal second member 108, and internal screw threads provided along the end fittings, push fit mechanism, etc). Furthermore, such end fittings are fabricated to have a smaller diameter as compared to the diameter of the retainers 310 and 312. Consequently, movement of the retainers 310 and 312 is obstructed by the end fittings (such as, when a force is applied on the coil spring 102), thereby, preventing escape of the retainers 310 and 312 from the longitudinal first member 106 and the longitudinal second member 108 respectively. In another embodiment, an alternative separate centre fitting such as a collet fitting may be fixed into the at least one of longitudinal first member 106 and the longitudinal second member 108 wherein its inner surface contracts to a slightly smaller diameter acting a stopper preventing the coil spring 102 and the retainer ends 104A-B or the spring end with at least two concentric coils arranged along a same plane, helical shaped coil from coming out of the longitudinal first member 106 and the longitudinal second member. In one embodiment, the depilatory device 100 further comprises pins 314 and 316 arranged through the retainable ends 104A-B of the coil spring 102 and the retainers 310 and 312, after detachably coupling the retainers 310 and 312 to the corresponding ends of the coil spring 102. Such pins 314 and 316 obstruct movement of the retainable ends 104A-B relative to the retainers 310 and 312, thereby, enabling to prevent detachment of the retainable ends 104A-B from the retainers 310 and 312 respectively.

In one embodiment, the retainers 310 and 312 are implemented as at least one of: an element having an internal recess configured to receive the end of the coil spring 102 therein, an element having a notch configured to receive the end of the coil spring 102 therein, an element having two halves configured to be detachably coupled together, an element having screw threads along an external surface thereof, or an element having screw threads along an internal surface thereof. For example, when the retainable ends 104A-B of the coil spring 102 are implemented as coils having the smaller diameter as compared to the diameter of the coil spring 102, the retainers 310 and 312 are implemented as cylindrical elements having an elongate cylindrical member along a center thereof. Furthermore, a recess is formed between the elongate cylindrical member (having a diameter substantially similar to the smaller diameter of coils of the retainable ends 104A-B of the coil spring 102) and internal surfaces of the retainers 310 and 312 respectively. In such an example, the coils of retainable ends 104A-B of the coil spring 102 are pushed against the elongate cylindrical member such that the elongate cylindrical member passes through the coils of the retainable ends 104A-B. Furthermore, due to the coils of retainable ends 104A-B experiencing expansion after being pushed into the recesses, the retainable ends 104A-B are snap-fit into the recess formed between elongate cylindrical members and the internal surfaces of the retainers 310 and 312 respectively. In another example, the retainable ends 104A-B of the coil spring 102 are implemented as closed-ended hooks (or open-ended hooks). Furthermore, the retainers 310 and 312 are implemented as elements having two halves configured to be detachably coupled together. In such an example, after arranging the closed-ended hooks of the coil spring 102 against a first half of the retainers 310 and 312, a second half of the retainers 310 and 312 respectively is fixedly coupled to the first half. Consequently, the retainable ends 104A-B of the coil spring 102 are retained between the corresponding two halves of the retainer 310 and 312.

On another embodiment, the retainer 310 and 312 has the at least one tab or the at least one pin that runs a long the provide recess or the see through hole along the partial length of the longitudinal first member 106 or the longitudinal second member 108, wherein the tab or pin is restricted beyond the corner implementing as a stopper preventing escape of the retainers 310 and 312 out of the longitudinal first member 106 and the longitudinal second member 108 when spring 102 is exposed for use. In such an example, the movement of the at least one tab 410 and 412 is restricted beyond the circular corner implementing as a stopper of the straight recess.

In a further embodiment within the longitudinal first member 106 and the longitudinal second member 108 may have the retainers with tabs or pins provided with the recess or see through holes and may have a stopper.

The various stopper as described holds the spring 102 with the retainable ends inside the longitudinal first member 106 and the longitudinal second member 108 within the device 100.

Figure 4:
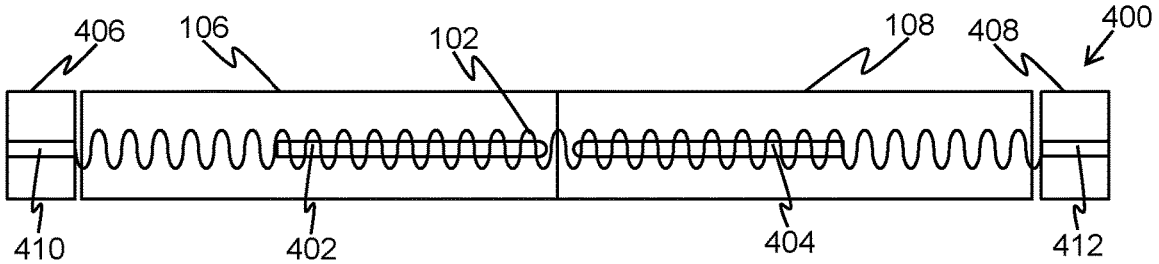
FIG. 4 is a schematic illustration of a depilatory device (such as the depilatory device of FIG. 3), in accordance with an embodiment of the present disclosure.

Referring to FIG. 4, there is shown a schematic illustration of a depilatory device 400 (such as the depilatory device 300 of FIG. 3), in accordance with an embodiment of the present disclosure. As shown, each of the longitudinal first member 106 and the longitudinal second member 108 further comprise retention mechanisms 402 and 404 respectively, and wherein the retention mechanisms 402 and 404 are implemented as at least one of: a straight recess provided along a partial length of the longitudinal first member 106 and the longitudinal second member 108 respectively, a straight recess provided along a length of the longitudinal first member 106 or the longitudinal second member 108 respectively, a recess provided along a circumference of the longitudinal first member 106 or the longitudinal second member 108 respectively, a helical recess provided along the circumference of the longitudinal first member or the longitudinal second member respectively, and/or a zig-zag recess provided along the length of the longitudinal first member 106 or the longitudinal second member 108 respectively. Furthermore, the depilatory device 400 comprises retainers 406 and 408 coupled to the longitudinal first member 106 and the longitudinal second member 108 respectively. The retainers 406 and 408 can be implemented such that a diameter thereof corresponds to the internal diameter of the longitudinal first member 106 and the longitudinal second member 108 respectively. However, when the diameter of the retainers 406 and 408 corresponds to the internal diameter of the longitudinal first member 106 and the longitudinal second member 108 respectively, the retainers 406 and 408 may escape into the longitudinal first member 106 and the longitudinal second member 108 (such as, when a force is applied on the coil spring 102). The retainers 406 and 408 comprise at least one tab 410 and 412 respectively, along a circumference thereof, wherein the at least one tab 410 and 412 is configured to be received in the retention mechanisms 402 and 404 of the longitudinal first member 106 and the longitudinal second member 108 respectively. For example, during use of the depilatory device 400, when a force is applied on the coil spring 102, the retainers 406 and 408 may escape into the longitudinal first member 106 and the longitudinal second member 108 respectively. In such an example, each of the retention mechanisms 402 and 404 are implemented as a straight recess provided along a partial length of the longitudinal first member 106 and the longitudinal second member 108 respectively. Thus, during movement of the retainers 406 and 408 along the longitudinal first member 106 and the longitudinal second member 108, the at least one tab 410 and 412 is received (such as, by getting caught within the recess) in the retention mechanisms 402 and 404 respectively. Optionally, the retention mechanisms 402 and 404 can be implemented as through-holes extending from the interior surfaces to the exterior surfaces of the longitudinal first member 106 and the longitudinal second member 108 respectively. Alternatively, the retention mechanisms 402 and 404 can be implemented to extend till a portion of a thickness of the longitudinal first member 106 and the longitudinal second member 108 respectively (for example, till a plane passing between the interior surfaces and the exterior surfaces of the longitudinal first member 106 and the longitudinal second member 108 respectively). Furthermore, the at least one tab 410 and 412 is configured to move within the retention mechanisms 402 and 404 till an end thereof. Subsequently, further movement of the tab 410 and 412 is obstructed by the end of the retention mechanisms 402 and 404, thereby preventing escape of the retainers 406 and 408 (and the coil spring 102) from the longitudinal first member 106 or the longitudinal 108 respectively. As shown, the straight recess provided along the partial length of the longitudinal first member 106 or the longitudinal second member respectively 108, further comprises a tapered end. Such a tapered end of the straight recess restricts the movement of the at least one tab 410 and 412 till an end thereof. For example, the tapered end of the straight recess can be implemented as having a circular corner (or as a straight recess having a cross-section corresponding to a squircle. In such an example, the movement of the at least one tab 410 and 412 is restricted beyond the circular corner implementing as a stopper of the straight recess. In another example, each of the retention mechanisms 402 and 404 are implemented as a helical recess provided along the circumference of the longitudinal first member 106 and the longitudinal second member 108 respectively. Furthermore, such a helical recess is fabricated such that the recess swirls along the length (such as a partial length) as well as circumference of the longitudinal first member 106 and the longitudinal second member 108 respectively. In such an example, the at least one tab 410 and 412 is configured to move around a central axis of the longitudinal first member 106 and the longitudinal second member 108, while moving downwards, when the force is applied on the coil spring 102. Subsequently, the movement of the at least one tab 410 and 412 is restricted at an end of the helical recess. Furthermore, on another embodiment within either or both end of the longitudinal first member 106 and the longitudinal second member 108 may provide an internal step or tapered smaller diameter acting as a stopper to restrict the retainer, a helical coil or the coil end with at least two concentric coils arranged along a same plane.

In an embodiment, the longitudinal first member 106 or the longitudinal second member 108 is provided with a plug or a sticker at the end of the straight recess or a see through-hole provided along the length of the longitudinal first member 106 or the longitudinal second member 108 respectively. For example, when the retention mechanisms 402 and 404 are implemented such that the straight recesses extend till ends of the longitudinal first member 106 and the longitudinal second member 108 (that are configured to be coupled together), the at least one tab 410 and 412 (and consequently, the retainers 406 and 408) may escape from open-ends of the straight recesses when the force is applied on the coil spring 102 (such as, during use of the depilatory device 400). In such an example, the plug (or optionally, a sticker that acts as an outward projection) is arranged at the end of the straight recess to obstruct the movement of the at least one tab 410 and 412 beyond the plug (or the sticker) or cap, thereby, preventing escape of the retainers 406 and 408 from the longitudinal first member 106 and the longitudinal second member 108 respectively.

According to one embodiment, the recess provided along the circumference of the longitudinal first member 106 or the longitudinal second member 108, further comprises at least one collar provided along the recess. For example, the retention mechanisms 402 and 404 are implemented as through-holes along a portion of the circumference of each of the longitudinal first member 106 or the longitudinal second member 108 respectively, wherein such through-holes are provided near the ends of the longitudinal first member 106 and the longitudinal second member 108 that are proximate to the retainable ends 104A-B of the coil spring 102 (or optionally, near the ends of the longitudinal first member 106 and the longitudinal second member 108 that are not proximate to the retainable ends 104A-B of the coil spring 102). In such an example, the recess is provided with the collar, such as, at a lower end thereof.

In one embodiment, the longitudinal first member 106 or the longitudinal second member 108 can be provided with the at least one tab, such that, each tab is implemented as a partial collar or a projection from the internal surfaces of the longitudinal first member 106 or the longitudinal second member 108 respectively. Consequently, the movement of the retainers 406 and 408 along the longitudinal first member 106 and the longitudinal second member 108 is restricted beyond the corresponding at least one tab, thereby, preventing escape of the retainers 406 and 408 from the longitudinal first member 106 and the longitudinal second member 108 respectively.

Figure 5:
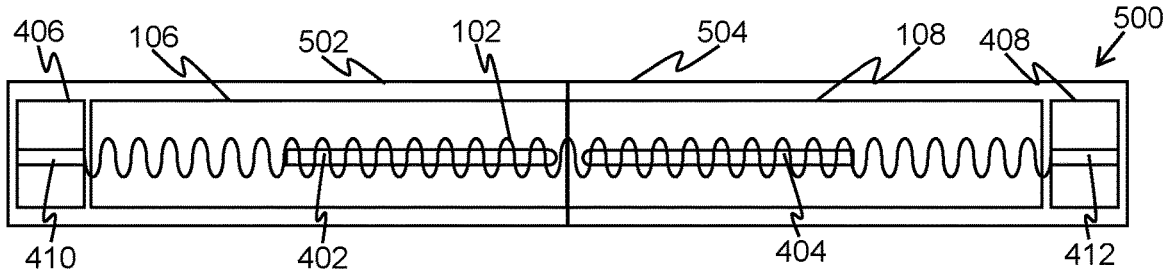
FIG. 5 is a schematic illustration of a depilatory device (such as the depilatory device of FIG. 4), in accordance with an embodiment of the present disclosure.

Referring to FIG. 5, there is shown a schematic illustration of a depilatory device 500 (such as the depilatory device 400 of FIG. 4), in accordance with an embodiment of the present disclosure. As shown, the depilatory device 500 comprises at least one sleeve implemented as sleeves 502 and 504, for covering the longitudinal first member 106 and the longitudinal second member 108. For example, when the depilatory device 500 is not in use, exposure thereof to environmental factors such as dust and humidity may damage one or more components thereof (such as due to clogging to dust, lint and so forth within the retention mechanisms 402 and 404). Furthermore, an impact of the depilatory device 500 (such as, due to falling) may damage such aforementioned one or more components thereof. In such examples, the at least one sleeve 502 and 504 prevents exposure of various components of the depilatory device 500 (such as the retainers 406 and 408, the at least one tab 410 and 412 and so forth) from deteriorating environmental factors and/or damage. It will be appreciated that the at least one sleeve can be arranged by receiving the longitudinal first member 106 into the sleeve 502 and the longitudinal second member 108 into the sleeve 504, subsequent to receiving the coil spring 102 into the longitudinal first member 106 and the longitudinal second member 108 respectively. Furthermore, the sleeves 502 and 504 can be fabricated to have a same shape (such as cylindrical members) or different shapes (such as the sleeve 502 is fabricated to have a substantially rectangular cross-section and the sleeve 502 is fabricated to have a substantially circular cross-section). Alternatively, at least one sleeve can be implemented as a single sleeve that is configured to receive each of the longitudinal first member 106 and the longitudinal second member 108 therein. The sleeve 502 and 504 can also be held by each hand to control pulling and rotating actions when removing hair from the exposed spring 102. Optionally, such a sleeve can be provided with a pocket clip to enable a user to conveniently carry the depilatory device 500.

In one embodiment, the depilatory device 500 further comprises a locking mechanism (not shown) to retain the coupling between the longitudinal first member 106 and the longitudinal second member 108, when the depilatory device 500 is maintained in the unused state. For example, the locking mechanism can be implemented as a clip provided on each of the longitudinal first member 106 and the longitudinal second member 108, wherein such clips are configured to be attached (or clipped) together to lock the coupling between the longitudinal first member 106 and the longitudinal second member 108. Optionally, the at least one sleeve implemented using the two sleeves 502 and 504 can be provided with a second locking mechanism between the two sleeves 502 and 504, to maintain the sleeves 502 and 504 in a coupled state when the depilatory device 500 is not in use. The locking mechanism provided on each of the longitudinal first member 106 and the longitudinal second member 108, can also comprise one of the centre fittings to retain the coupling between the longitudinal first member 106 and the longitudinal second member 108 such as a push fit, screw thread, collet fit, magnet fit or an interference fit.

In an embodiment, the depilatory device 500 further comprises a cap fixedly, detachably or hingedly coupled to an open end of the at least one sleeve 502 and 504 for covering the longitudinal first member 106 and the longitudinal second member 108. Such a cap can be provided to prevent escape of the longitudinal first member 106 coupled to the longitudinal second member 108 from the open end of the at least one sleeve. Moreover, the caps can be implemented to permanently close the at least one sleeve 502 and 504 (such as, by integrally fabricating the caps with the at least one sleeve 502 and 504) or the caps can be configured to be opened and closed as required (such as, by fabricating the caps to be detachably or hingedly coupled to the open end of the at least one sleeve 502 and 504). The caps can also be provided to an open end of the at least one longitudinal first member 106 or the longitudinal second member 108.

In one embodiment, the depilatory device 500 further comprises a hollow volume within the at least one sleeve, between the cap and the longitudinal first member 106 or the longitudinal second member 108 respectively. For example, a length of the at least one sleeve can be more than a length of the longitudinal first member 106 or the longitudinal second member 108, such that the hollow volume is formed within the sleeve between the cap and the longitudinal first member 106 or the longitudinal second member 108 respectively. In such an example, the hollow volume can be utilized for carrying one or more other cosmetic products therein, including but not limited to, a lipstick, nail-clippers, eyebrow pencil, tweezers and so forth. Furthermore, the hollow volume can be implemented as at least two compartments, wherein each of the at least two compartments can be utilized for carrying a different item therein.

According to one embodiment, each of the longitudinal first member 106 and the longitudinal second member 108 comprises a collar on at least one end thereof. For example, the collar can be provided on each of the longitudinal first member 106 and the longitudinal second member 108 on the ends thereof that is coupled together when the depilatory device 500 is not in use. Such a collar is configured to act as a stopper for preventing movement of the longitudinal first member 106 and the longitudinal second member 108 into the at least one sleeve. Optionally, the at least one sleeve is fabricated integrally with the longitudinal first member 106 and the longitudinal second member 108. For example, when the at least one sleeve is implemented as sleeves 502 and 504, the sleeve 502 is integrally fabricated with the longitudinal first member 106 and the sleeve 504 is integrally fabricated with the longitudinal second member 108.

According to another embodiment, the longitudinal first member 106, the longitudinal second member 108 may be fitted with a light to see the hair (this could be powered by battery)

According to a further embodiment, the longitudinal first member 106, the longitudinal second member 108 and/or the at least one sleeve 502 and 504 is fabricated using at least one of: metals, plastics, wood, ceramics. For example, each of the longitudinal first member 106 and the longitudinal second member 108 are fabricated using stainless steel and the at least one sleeve 502 and 504 is fabricated using Polyvinyl Chloride (PVC). In another example, each of the longitudinal first member 106 and the longitudinal second member 108 are fabricated using porcelain and the at least one sleeve 502 and 504 is fabricated using a non-splintering wood (such as, ash, oak, aspen, hickory, teak, mahogany and so forth.

Modifications to embodiments of the invention described in the foregoing are possible without departing from the scope of the invention as defined by the accompanying claims. Expressions such as "including", "comprising", "incorporating", "consisting of", "have", "is" used to describe and claim the present invention are intended to be construed in a non-exclusive manner, namely allowing for items, components or elements not explicitly described also to be present. Reference to the singular is also to be construed to relate to the plural. Numerals included within parentheses in the accompanying claims are intended to assist understanding of the claims and should not be construed in any way to limit subject matter claimed by these claims.

The invention claimed is:

1. A depilatory device comprising:

a coil spring having retainable ends;

a longitudinal first member configured to receive one retainable end of the coil spring, wherein the retainable end of the coil spring is retained in the longitudinal first member; and a longitudinal second member configured to receive another retainable end of the coil spring, wherein the other retainable end of the coil spring is retained in the longitudinal second member;

wherein the longitudinal first member is configured to couple with the longitudinal second member to conceal the coil spring, when the depilatory device is maintained in an unused state; and the longitudinal first member is separated from the longitudinal second member to reveal the coil spring for performing a depilatory action, when the depilatory device is in use.

2. The depilatory device according to claim 1, wherein the longitudinal first member and/or the longitudinal second member comprises a stopper for retaining the retainable ends of the coil spring, wherein the stopper may be implemented at least one of: a collar along the circumference at either end of the longitudinal first member and the longitudinal second member, a tapered end or corner provided on a recess or a see through hole for a pin or a tab, a collet fitting may be fixed into the at least one of longitudinal first member and the longitudinal second member wherein its inner surface contracts to a slightly smaller diameter acting a stopper, an internal step or a tapered smaller diameter at either end of the longitudinal first member and the longitudinal second member.

3. The depilatory device according to claim 1, further comprising at least one sleeve for covering the longitudinal first member and the longitudinal second member.

4. The depilatory device according to claim 3, further comprising a cap fixedly, detachably or hingedly coupled to an open end or integrally fabricating the cap with at least one sleeve covering the longitudinal first member and the longitudinal second member.

5. The depilatory device according to claim 4, further comprising a hollow volume within the at least one sleeve, between the cap and the longitudinal first member or the longitudinal second member respectively, the hollow volume can be utilized for carrying one or more other cosmetic products therein, including but not limited to a lipstick, nail-clippers, eyebrow pencil, tweezers.

6. The depilatory device according to claim 3, wherein at least one sleeve is implemented as sleeves and the sleeves are integrally fabricated with the longitudinal first member and the sleeve is integrally fabricated with the longitudinal second member.

7. The depilatory device according to claim 1, further comprising a cap fixedly, detachably or hingedly coupled to an open end or integrally fabricating the cap with at least one of the longitudinal first member and the longitudinal second member.

8. The depilatory device according to claim 1, further comprising a retainer detachably coupled to each retainable end of the coil spring after the corresponding retainable end of the coil spring is received in the longitudinal first member or the longitudinal second member, wherein the retainer is configured to prevent release of the corresponding retainable end of the coil spring from the longitudinal first member or the longitudinal second member respectively, the retainers can be implemented to have cylindrical elements or a circular cross-section, rectangular cross-section or a triangular cross-section.

9. The depilatory device according to claim 8, wherein the retainer is implemented to have a circular cross-section, and wherein the diameter of the retainer is bigger than a diameter of the coil spring.

10. The depilatory device according to claim 8, wherein the retainer is implemented as at least one of: an element having an internal recess configured to receive the end of the coil spring therein, an element having a notch configured to receive the end of the coil spring therein, an element having two halves configured to be detachably coupled together, an element having screw threads along an external surface thereof, an element having screw threads along an internal surface thereof.

11. The depilatory device according to claim 8, wherein the retainer comprises at least one tab or pin along a circumference thereof, wherein the at least one tab or pin is configured to be received in the retention mechanisms of the longitudinal first member and the longitudinal second member respectively.

12. The depilatory device according to claim 8, wherein the retainer comprises a collar for preventing release thereof from the longitudinal first member or the longitudinal second member.

13. The depilatory device according to claim 1, wherein the retainable ends of the coil spring are implemented as one of: open-ended hooks, closed-ended hooks, coils having a smaller diameter as compared to a diameter of the coil spring, helical shaped coil, coils having a bigger diameter as compared to the diameter of the coil spring, at least one coil having an increased separation therebetween as compared to other coils of the coil spring, at least two concentric coils arranged along a same plane.

14. The depilatory device according to claim 1, wherein each of the longitudinal first member and the longitudinal second member further comprise retention mechanisms, and wherein the retention mechanisms are implemented as at least one of: a straight recess provided along a partial length of the longitudinal first member or the longitudinal second member respectively, a straight recess provided along a length of the longitudinal first member or the longitudinal second member respectively, a recess provided along a circumference of the longitudinal first member or the longitudinal second member respectively, a helical recess provided along the circumference of the longitudinal first member or the longitudinal second member respectively, a zig-zag recess provided along the length of the longitudinal first member or the longitudinal second member respectively.

15. The depilatory device according to claim 14, wherein the longitudinal first member or the longitudinal second member is provided with a plug or a lid or a sticker at the end of the straight recess or see through hole provided along the length of the longitudinal first member or the longitudinal second member respectively.

16. The depilatory device according to claim 1, wherein:

the longitudinal first member is implemented as a male member and the longitudinal second member is implemented as a female member, or each of the longitudinal first member and the longitudinal second member comprise magnetic ends, or the longitudinal first member comprises threads on an external surface thereof and the longitudinal second member comprises threads on an internal surface thereof, or an end of the longitudinal first member is configured to snap-fit into an end of the longitudinal second member.

17. The depilatory device according to claim 1, wherein each of the longitudinal first member and the longitudinal second member are provided with centre fittings such as a push fit, screw thread, collet fit, clip fit, magnet fit or an interference fit that can be fixed or detached, wherein the centre fittings enable the longitudinal first member to couple with the longitudinal second member.

18. The depilatory device according to claim 1, wherein each of the longitudinal first member and the longitudinal second member further comprise retention mechanisms, and wherein the retention mechanisms are implemented as through-holes extending from the interior surfaces to the exterior surfaces of the longitudinal first member.

19. The depilatory device according to claim 1, wherein the longitudinal first member and the longitudinal second member may be fitted with a light to see the hair.

20. The depilatory device according to claim 1, wherein at least one of the longitudinal first member and the longitudinal second member can be implemented as substantially cylindrical elements or can be implemented to have different cross-sections with respect to each other such as rectangular cross-section, triangular cross-section or with a cylindrical element, further the sleeve can be fabricated to have a same shape or different shape such as cylindrical, rectangular cross-section or a circular cross-section.

* * * * *